US006000350A

United States Patent [19]

Koike et al.

[11] Patent Number: 6,000,350

[45] Date of Patent: Dec. 14, 1999

[54] EMBROIDERING POSITION SETTING DEVICE AND METHOD OF OPERATION THEREOF FOR AN EMBROIDERING SEWING MACHINE

[75] Inventors: Mikio Koike; Chiyo Suzuki; Shinichi Fuchigami; Akiyoshi Sasano; Shinichi Fukada, all of Tokyo, Japan

[73] Assignee: Janome Sewing Machine Co., Ltd., Tokyo, Japan

[21] Appl. No.: 08/709,410

[22] Filed: Sep. 6, 1996

[51] Int. Cl.[6] ..... D05B 21/00; D05C 5/02

[52] U.S. Cl. ..... 112/102.5; 112/445; 112/475.19

[58] Field of Search ..... 112/102.5, 103, 112/470.06, 454, 445, 470.04, 475.19

[56] References Cited

U.S. PATENT DOCUMENTS 4,768,450 9/1988 Kato et al. ..... 112/102.5
5,553,559 9/1996 Inoue et al. ..... 112/102.5

FOREIGN PATENT DOCUMENTS 1-57594 12/1989 Japan .

*Primary Examiner*—Peter Nerbun
*Attorney, Agent, or Firm*—Lowe Hauptman Gopstein Gilman & Berner

[57] ABSTRACT

An embroidering position setting device and method of operation thereof for an embroidering sewing machine are described. The embroidering sewing machine is capable of storing pattern data in a memory for a plurality of embroidery patterns which can be selectively read out to operate a stitch forming device to form the stitches of a selected pattern or patterns on a cloth to be stitched. An embroidering frame has a cloth extended thereon to be embroidered and is connected to an X-Y drive mechanism, said cloth having a mark located at an optional position for representing a reference embroidering position of the cloth. Jog keys are selectively operated to operate said X-Y drive mechanism thereby to shift said embroidering frame so that said reference embroidering position mark of the cloth may be located at the position under said machine needle in vertical alignment therewith. The position register key is operated to store said position of the reference embroidering position mark in an embroidering position memory as the reference embroidering position data. This position of the reference embroidering position mark is indicated together with crossed lines on a display which is operative in response to operation of said position register key. A pattern selecting device is then operated to select at least one of the embroidery patterns from said pattern memory, said selected embroidery pattern being stored in a memory (RAM) and being simultaneously indicated on said display with the center thereof being located at the center of said crossed lines.

19 Claims, 17 Drawing Sheets

EMBROIDERING POSITION SETTING DEVICE AND METHOD OF OPERATION THEREOF FOR AN EMBROIDERING SEWING MACHINE

FIELD OF THE INVENTION

The present invention relates to an embroidery position setting device and the method of use thereof for an embroidery sewing machine, and more particularly to a device and method for setting on a display a layout of a pattern(s) to be embroidered prior to execution of the embroidery stitching.

BACKGROUND OF THE INVENTION

It is generally known that embroidery sewing machines embroider a pattern or patterns on a cloth, the position of which is varied relative to the machine needle in synchronism with a vertical reciprocation therewith. When a pattern or patterns are to be embroidered on a desired position of the cloth, the machine operator places a mark on the cloth to be extended on an embroidering frame, and then shifts the frame so that the mark is positioned under the machine needle prior to stitching. A plurality of patterns may be embroidered with the arrangement in a desired direction inclined or curved with a predetermined space provided therebetween.

The foregoing technique is disclosed in the Japanese patent published Hei 1(1989)-57594. However it has been difficult to correctly stitch a pattern or patterns at a desired place and with a desired arrangement on the cloth. It has also been difficult to additionally arrange the patterns in the course of stitching with respect to a preceding selected pattern or patterns. Further it has been difficult to make a reference embroidering position coincide with the machine needle which is held at the upper position.

SUMMARY OF THE INVENTION

The present invention eliminates the defects and disadvantages of the prior art. The present invention relates to an embroidery sewing machine capable of storing in its memory pattern data which can be selectively read out to operate the stitch forming device of the sewing machine to embroider the selected pattern or patterns on the cloth. The embroidery sewing machine comprises an embroidering frame for having the cloth extended thereon, the cloth being given at a desired position thereof a reference embroidering position (one or two points, or one point+one or two lines), a frame shifting means for shifting or moving the embroidering frame relative to the machine needle, a position register key for shifting the embroidering frame so that the reference embroidering position is brought to the place under the machine needle to register the reference embroidering position in an embroidering position memory, a display for indicating the reference embroidering position thereon, an image control means operated in response to operation of the position register key to indicate on the display crossed lines XY in connection with the reference embroidering position and a pattern selecting means selectively operated to select a desired pattern or patterns to be indicated on the display in connection with the crossed lines XY, wherein operation of the position register key will shift the reference embroidering position of the cloth to the position under the machine needle and register the reference embroidering position in the embroidering position memory and simultaneously cause the display to indicate thereon the reference embroidering position together with the crossed lines XY, and selective operation of the pattern selecting means will select a desired pattern or patterns to be embroidered and simultaneously cause the display to indicate the selected pattern or patterns thereon in connection with the crossed lines XY, and then operation of the frame shifting means will optionally shift the embroidering frame with respect to the crossed lines XY so that the selected pattern or patterns may be optionally arranged on the display.

It is therefore a principal object of the invention to exactly place the cloth to be embroidered at a desired position in reference to a display by means of a reference embroidering position mark optionally placed on to the cloth and crossed lines XY provided in connection with the reference embroidering position mark for determination of the initial embroidering position.

It is another object of the invention to switch the sewing machine to an embroidering mode wherein the machine needle automatically comes down from the upper dead position to a predetermined lower position close to the cloth to more easily make the reference embroidering position of the cloth coincide with the machine needle for determination of the initial embroidering position.

It is another object of the invention to switch the sewing machine to an embroidering mode wherein the presser foot automatically comes down from the upper dead position to a predetermined lower position where the presser foot is in contact with the cloth to be embroidered to more easily make the reference embroidering position of the cloth coincide with the presser foot for determination of the initial embroidering position.

It is another object of the invention to provide auxiliary lines in connection with the crossed lines XY with a predetermined space provided therebetween to more easily and more precisely arrange a selected pattern or patterns on the display.

It is still another object of the invention to enable the machine operator to more easily operate the embroidering sewing machine to determine the initial embroidering position of the cloth to be embroidered prior to execution of the embroidery stitching.

DETAILED DESCRIPTION OF THE PREFERRED EMBODIMENTS

Figure 1:
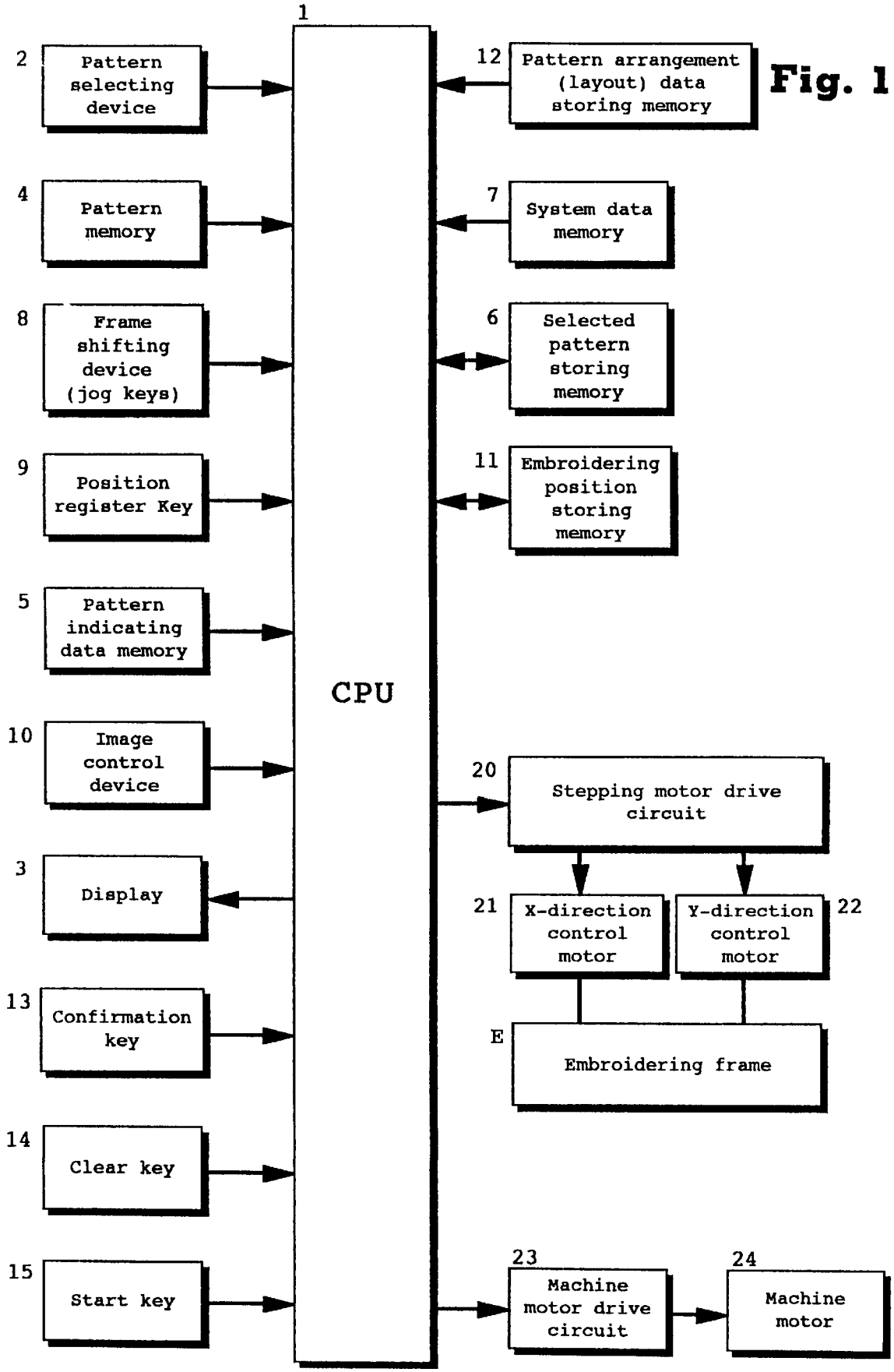
FIG. 1 is a block diagram showing a device of a first embodiment of the invention.
Figure 10:
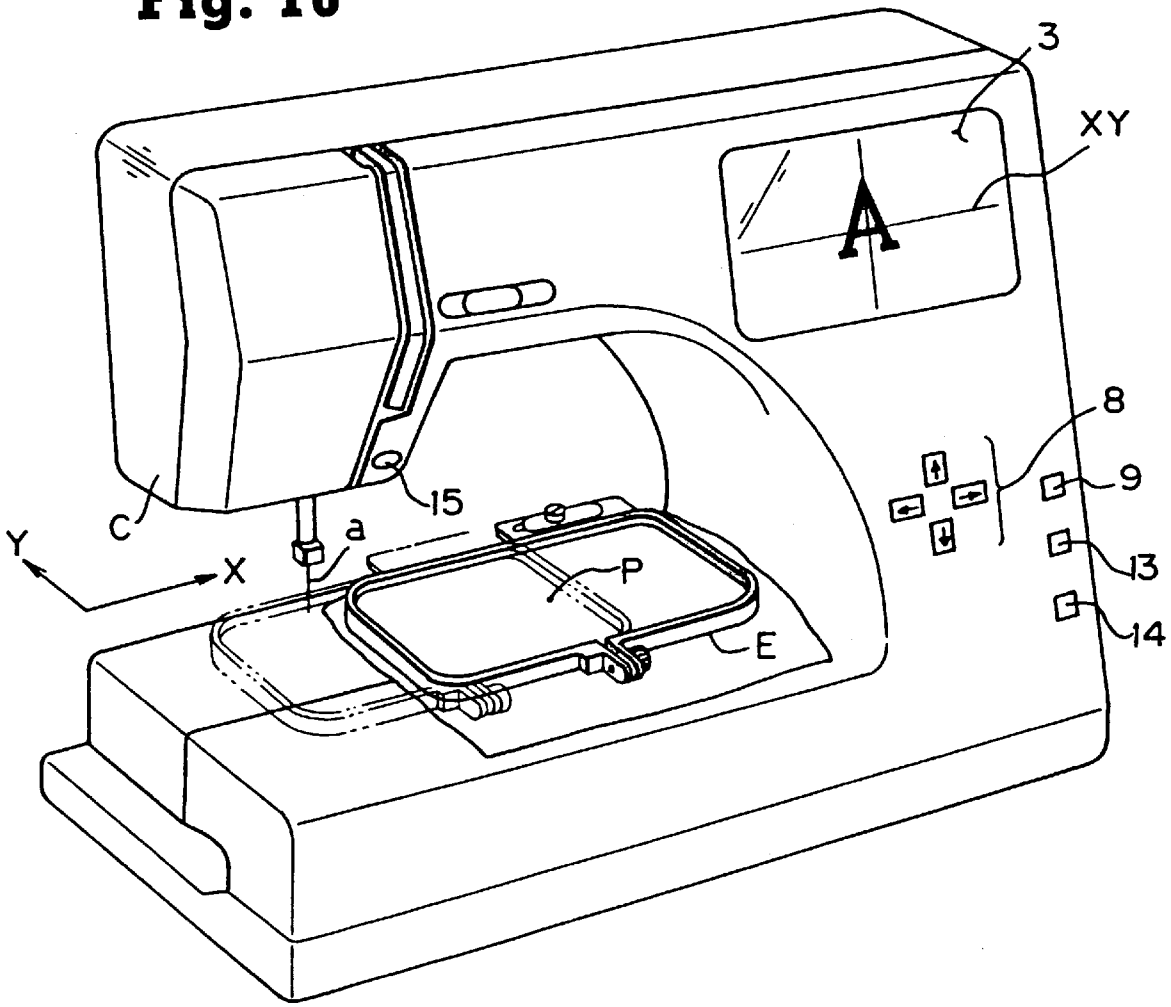
FIG. 10 is a perspective view of an embroidering sewing machine incorporated with the present invention.

The invention will now be described in reference to FIGS. 1, 2 and 10. An embroidering sewing machine has incorporated therein a central processing unit (CPU)1 containing a computer program therein for enabling the sewing machine to form various embroidering stitch patterns.

The sewing machine has a pattern selecting device 2 which includes a plurality of pattern selecting keys or touch switches (not shown), which are used to select one of the stitch patterns, and a display 3 operated to indicate the stitch pattern selected using the pattern selecting device 2. The pattern selecting device 2 selectively produces a pattern signal designating a corresponding one of the stored stitch patterns. The display 3, which may be a liquid crystal display (LCD), is responsive to the selective operation of the pattern selecting device 2 to indicate the selected stitch pattern on the basis of the corresponding pattern data stored in a pattern indicating data storing memory 5.

The sewing machine further has a pattern data memory 4 therein for storing therein pattern data for a plurality of stitch patterns to be selectively read out of the memory 4 to drive a cloth holding frame (which will be described later, in X and Y directions to form a stitch pattern on a cloth held by the cloth holding frame.

A pattern indicating data storing memory (ROM) 5 is provided in the sewing machine and has pattern indicating data stored therein which corresponds to the pattern data respectively which is stored in the pattern data storing memory 4. The pattern indicating data are employed to indicate the corresponding patterns on the display 3. In this embodiment, the pattern indicating data are stored in the memory 5 separate from the pattern data storing memory 4. However the pattern indicating data and the pattern data may be stored in a single memory, which may of course be an external element.

A memory (RAM) 6 is provided to temporarily store the pattern data for the stitch pattern selected by operation of the pattern selecting device 2. A system data storing memory (ROM) 7 is provided to store therein the system program data for controlling the operations of control motors which are driven in accordance with selection and display of the stitch patterns and drive of the sewing machine.

A frame shifting device 8 is provided to drive an embroidering frame E in the X and Y directions. The frame shifting device 8 includes a plurality of jog keys which are selectively operated to move the embroidering frame E from one place to another place on the sewing machine while the position data is counted up until the frame is moved to a desired position. A position register key 9 is provided so as to be operated to indicate in the display 3 a reference embroidering position (q) (one or two points, one point+one line, or two lines) which is optionally determined on a cloth extended on the embroidering frame E, and simultaneously to register the data. More precisely, when the position register key 9 is operated (pressed), the position register mode is set. Simultaneously an initial embroidering point or a mechanical original point (p) is set to be the center of the embroidering frame E and a machine needle (a) is shifted to the initial embroidering point or the mechanical original point (p). The jog keys of the frame moving device 8 are selectively operated to move the embroidering frame E and place the reference embroidering position (q) at the position under the needle (a) and vertically in alignment therewith. The position register key 9 is then operated to register the position as the embroidering position. Simultaneously the cross-line data XY stored in an image control device 10 is read out to indicate the cross-lines XY at the center of the display 3, and the moving amount of the embroidering frame E between the initial embroidering point (p) and the reference embroidering position (q) is stored in an embroidering position memory 11 as the position data.

Figure 11A:
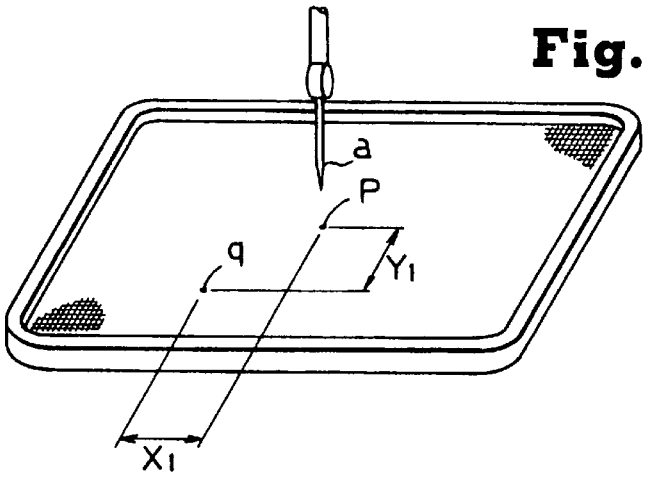
FIG. 11(A) is a perspective view of a machine needle and an embroidering frame having a cloth extended thereon, showing a positional relationship between the machine needle, an initial embroidering point and a reference embroidering position.
Figure 11B:
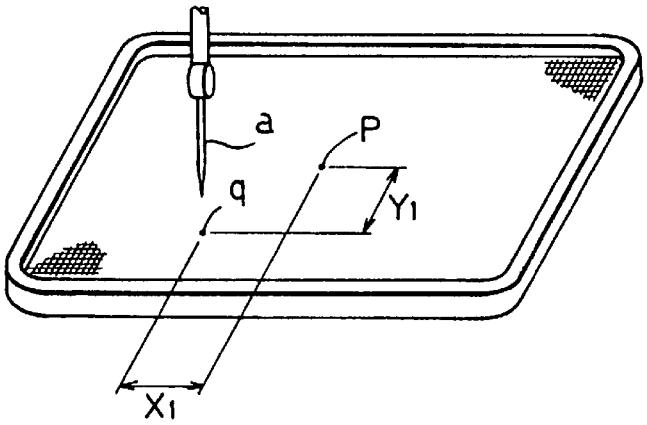
FIG. 11(B) is a perspective view showing the reference embroidering position shifted to the position under the machine needle in vertical alignment therewith.
Figure 11C:
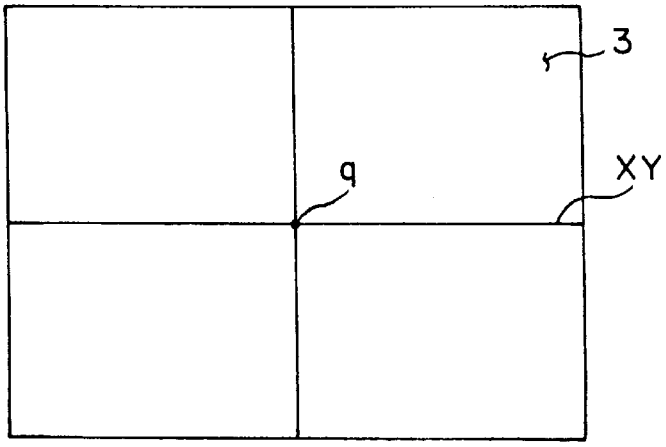
FIG. 11(C) is a plan elevational view of a display indicating crossed lines XY thereon while the condition of FIG. 11(B) is registered.

The image control device 10 stores therein the cross-line XY data which is read out by operation of the position register key 9 to indicate the cross-lines X and Y in the display 3 at the center thereof as shown in FIG. 11(C). The embroidering position memory 11 stores therein the XY moving amount between the initial embroidering point (p) and the embroidering reference position (q) as the moving amount data.

A pattern arrangement data memory 12 stores therein the data for arranging a selected pattern to be embroidered in connection with the cross-lines XY indicated on the display 3.

A confirmation key 13 is operated to confirm a positional relation between a plurality of selected patterns arranged as desired on the display 3. A clear key 14 is operated to invalidate the precededly selected layout of the patterns and return the embroidering frame E to the initial embroidering point (p).

Numerals 21 and 22 designate stepping motors for controlling the X-direction and the Y-direction respectively of the embroidering frame E to be moved. Namely the stepping motors are driven to change the relative position between the needle and the embroidering frame E having a cloth extended thereon to be embroidered. The stepping motors 21, 22 are connected to a central processing unit 1 through a stepping motor drive circuit 20. A machine motor 24 is driven by way of a machine motor drive circuit 23 to vertically reciprocate the machine needle (a).

Figure 2:
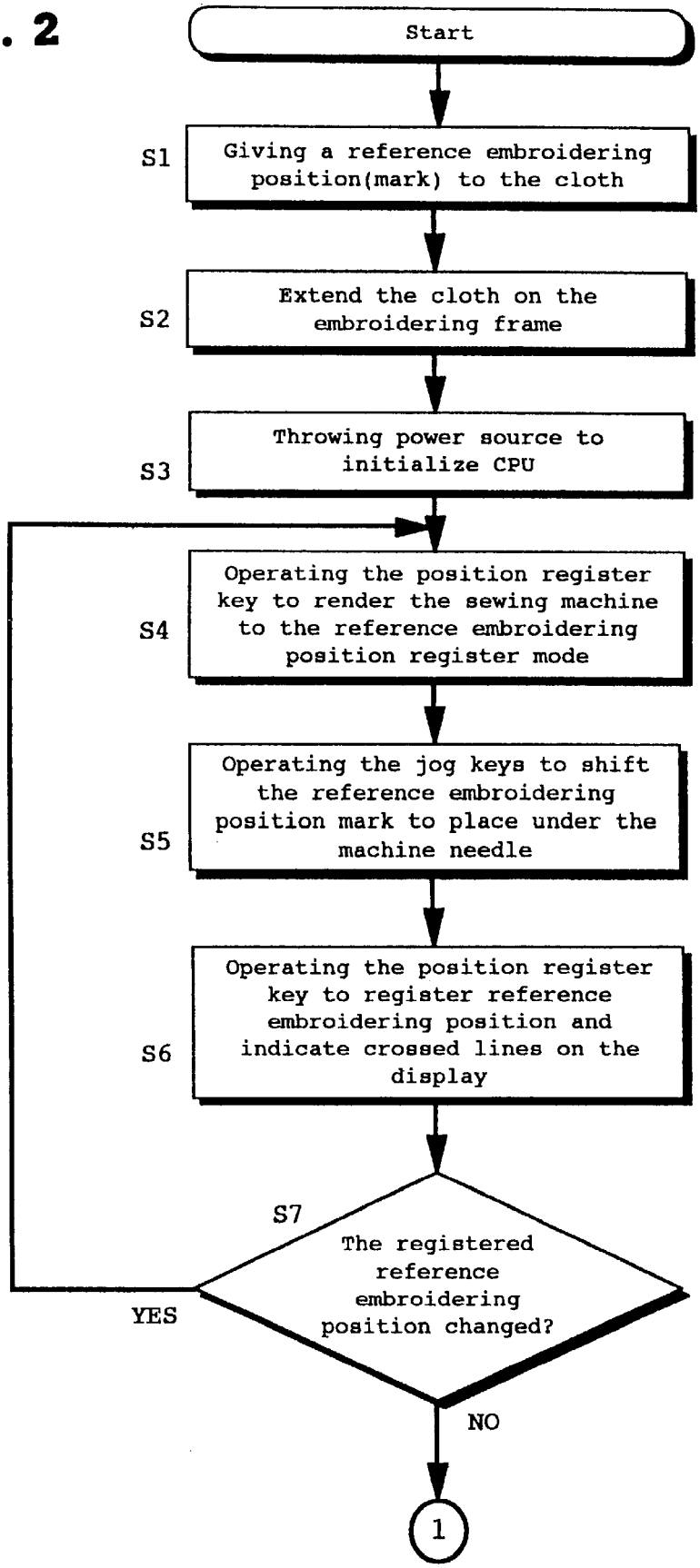
FIGS. 2 and 2(A) are a flow chart according to the device of the first embodiment of the invention.
Figure 2A:
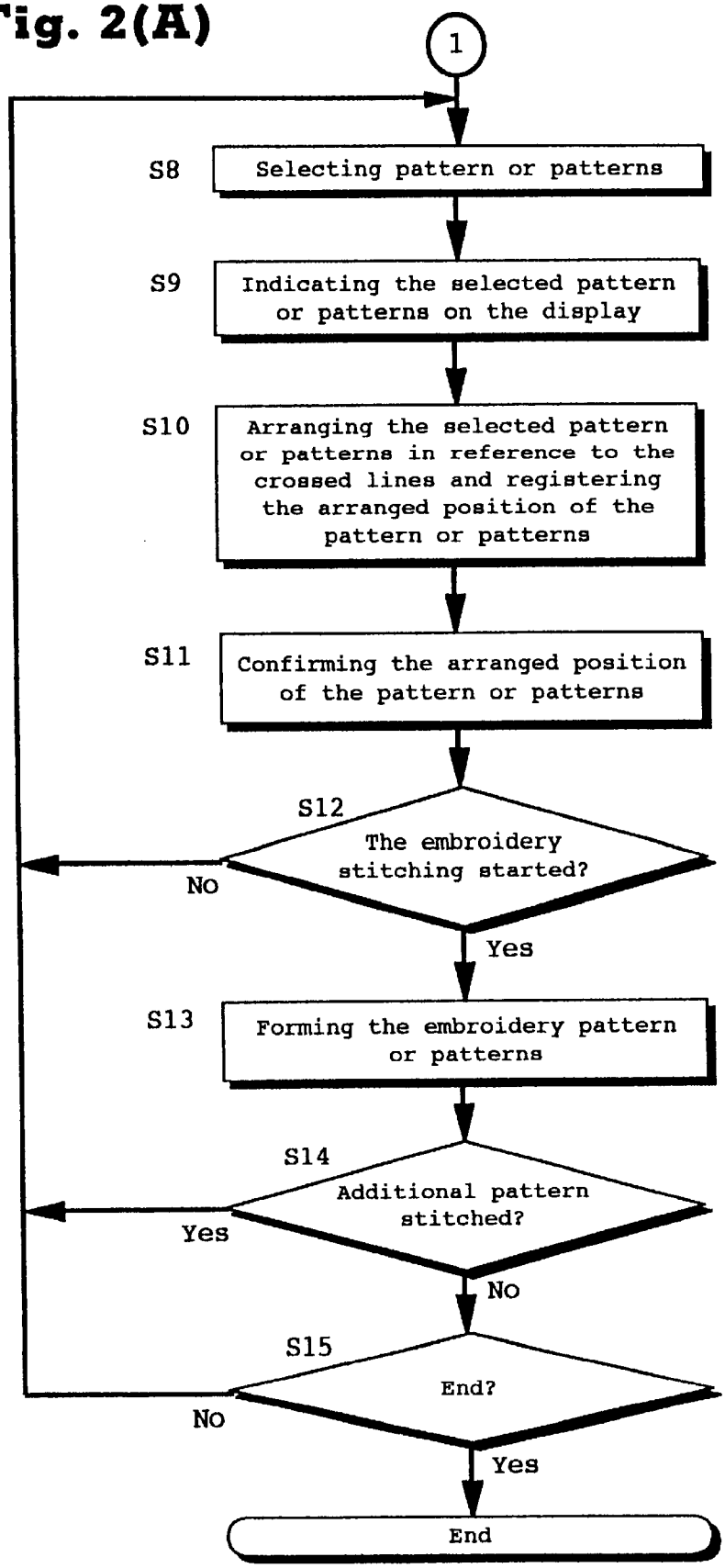
Figure 12A:
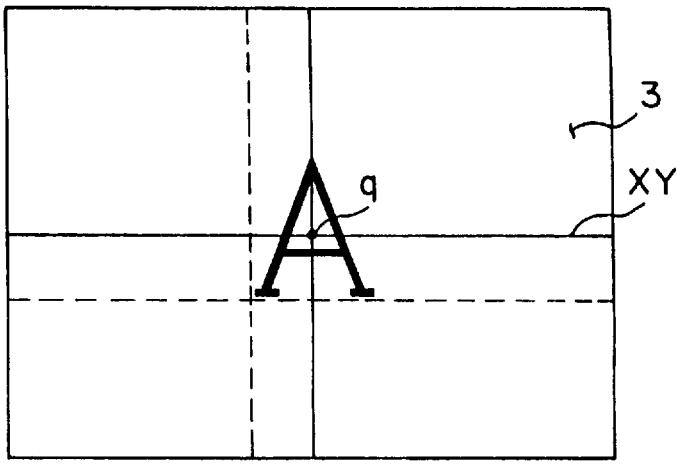
FIG. 12(A) is a plan elevational view of the display showing a selected pattern indicated on the crossed lines XY.
Figure 12B:
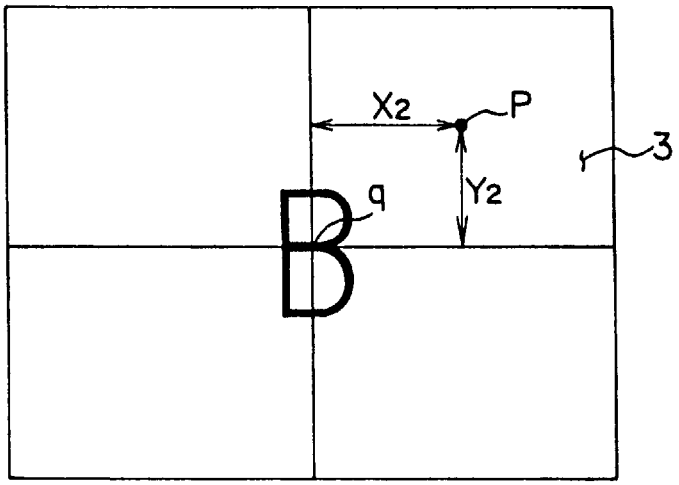
FIG. 12(B) is a plan elevational view of the display showing another selected pattern indicated after the preceded pattern has been embroidered.
Figure 12C:
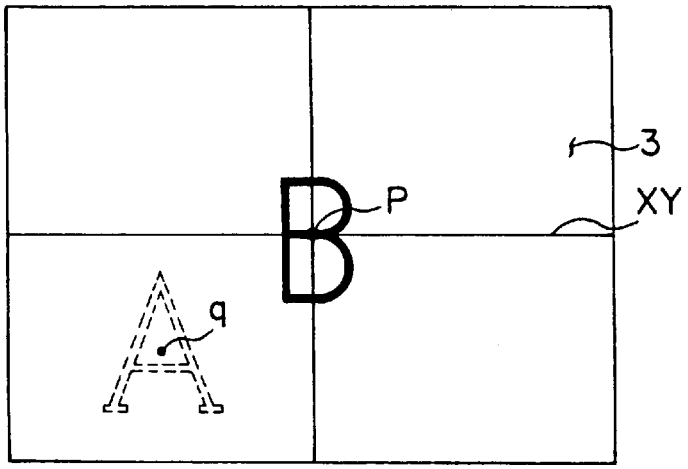
FIG. 12(C) is a plan elevational view of the display showing the another selected pattern arranged in connection with the precededly embroidered pattern by shifting the crossed lines XY.

The function of the device according to the first embodiment of the invention will now be described in reference to the flow chart as shown in FIG. 2. First of all, the embroidering reference position (q) is given at a desired position on the cloth to be embroidered (S1). The cloth is set onto the embroidering frame E (S2). The embroidering frame E is attached to an X-Y drive mechanism of the embroidering sewing machine and a power supply of the sewing machine is thrown to initialize the computer program (S3). The position registry key 9 is operated to render the sewing machine to the embroidering position registry mode (S4). The jog keys of the frame shifting device 8 are selectively operated to shift the embroidering frame E from the initial embroidering point or the mechanical original point (p) and place the point (q) to a position just under the needle (a) (S5). Then the position registry key 9 is operated again to register the position of the point (q) as the reference embroidering position of a pattern to be embroidered(the point (q) being shifted from the point (p) by −X in the direction X and −Y in the direction Y), and simultaneously the crossed lines XY are indicated at the center of the display 3 (S6, FIG. 11(C)), and the shifting amount of the point (q) is stored in the embroidering position memory 11 as the position data. Then a determination is made as to whether the registered reference embroidering position (q) is to be changed (S7). If a change is made, the procedure is returned to before the step (S4) where the position register key 9 is operated. If no change is made, the pattern selecting device 2 is operated to select a desired pattern to be embroidered (S8). The selected pattern is indicated on the display 3 in the condition that the center of the pattern is located at the center of the crossed lines XY (S9, FIG. 12(A)).

Subsequently in reference to the crossed lines XY and the pattern indicated in the display, reconsideration may be given to determine a most desired position of the pattern. The jog keys of the frame shifting device 8 are selectively operated to shift the embroidering frame E optionally in the directions X and Y. Then the crossed lines XY are shifted accordingly in the directions X and Y while the pattern remains unmoved.

With this arrangement or layout of the pattern being determined, the arrangement data is stored in the pattern arranging data memory 12 (S10), and the arrangement or layout of the pattern is determined (S11). Then a determination is made regarding whether the embroidery stitching is started or not (S12). If it is decided that the embroidery stitching should be started, then the starting key 15 is operated to start the embroidery stitching (S13). After the embroidery stitching has been finished, a determination is made regarding whether an additional pattern is stitched (S14). If an additional pattern is going to be stitched, then the procedure is returned to before the step (S8) where selective operation of the pattern selecting device 2 is made. If no additional pattern is to be stitched, then a determination is made regarding whether the embroidery stitching has been finished (S15). If this is "yes", then the embroidery stitching has been finished.

Figure 3:
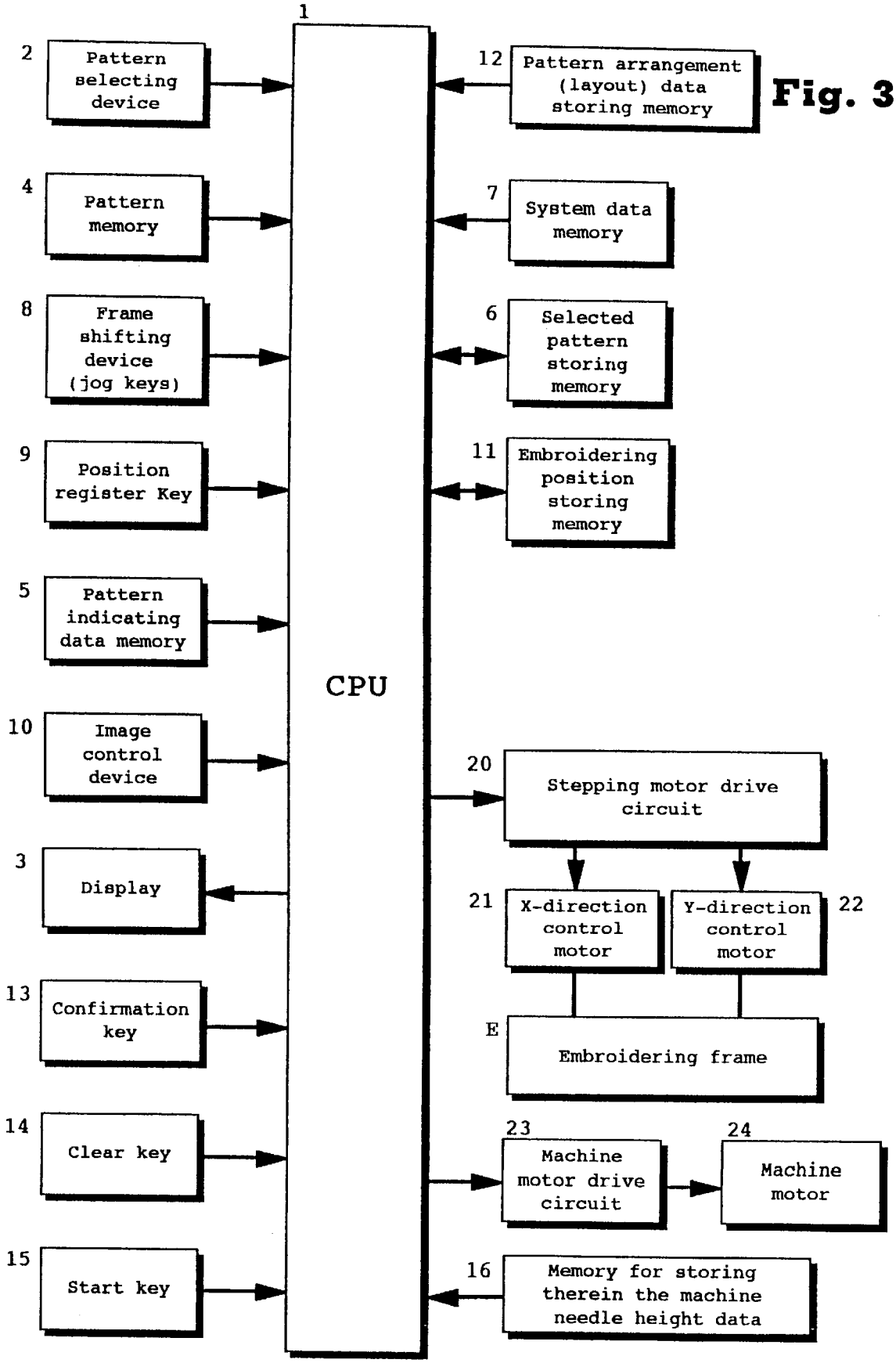
FIG. 3 is a block diagram showing a device of a second embodiment of the invention.
Figure 16A:
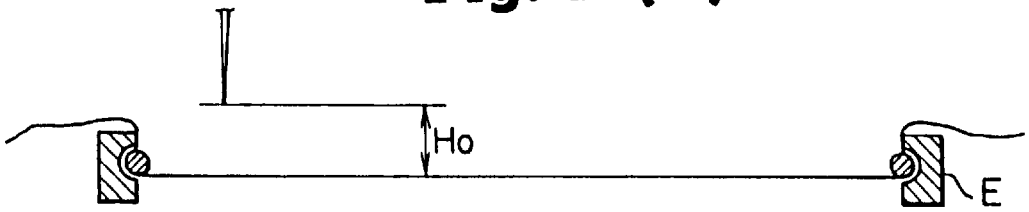
FIG. 16(A) is a side elevational view of the machine needle and the embroidering frame shown partly broken in vertical section showing the machine needle held in the upper dead position.
Figure 16B:
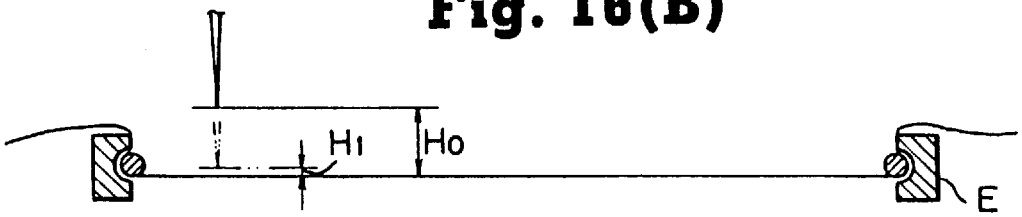
FIG. 16(B) shows the machine needle coming down to a predetermined lower position close to the cloth extended on the embroidering frame before the reference embroidering position mark is shifted to under the machine needle.

FIG. 3 shows a device according to a second embodiment of the invention. This embodiment is the same with the above-mentioned first embodiment except for being additional provided with a needle height data memory 16 which stores therein a control data for controlling the height of the needle (a). As shown in FIG. 16 (A), the height of the needle (lower end) from the cloth to be embroidered is normally Ho when the needle is brought up. However according to the embodiment, the needle height is reduced to H1 as shown in FIG. 16(B) by operation of the position register key 9 so that the reference embroidering position (q) may be more exactly placed under the needle in alignment therewith. When the position register key 9 is operated again before the embroidery stitching is started, the needle is returned to the normal height Ho (S72).

Figure 4:
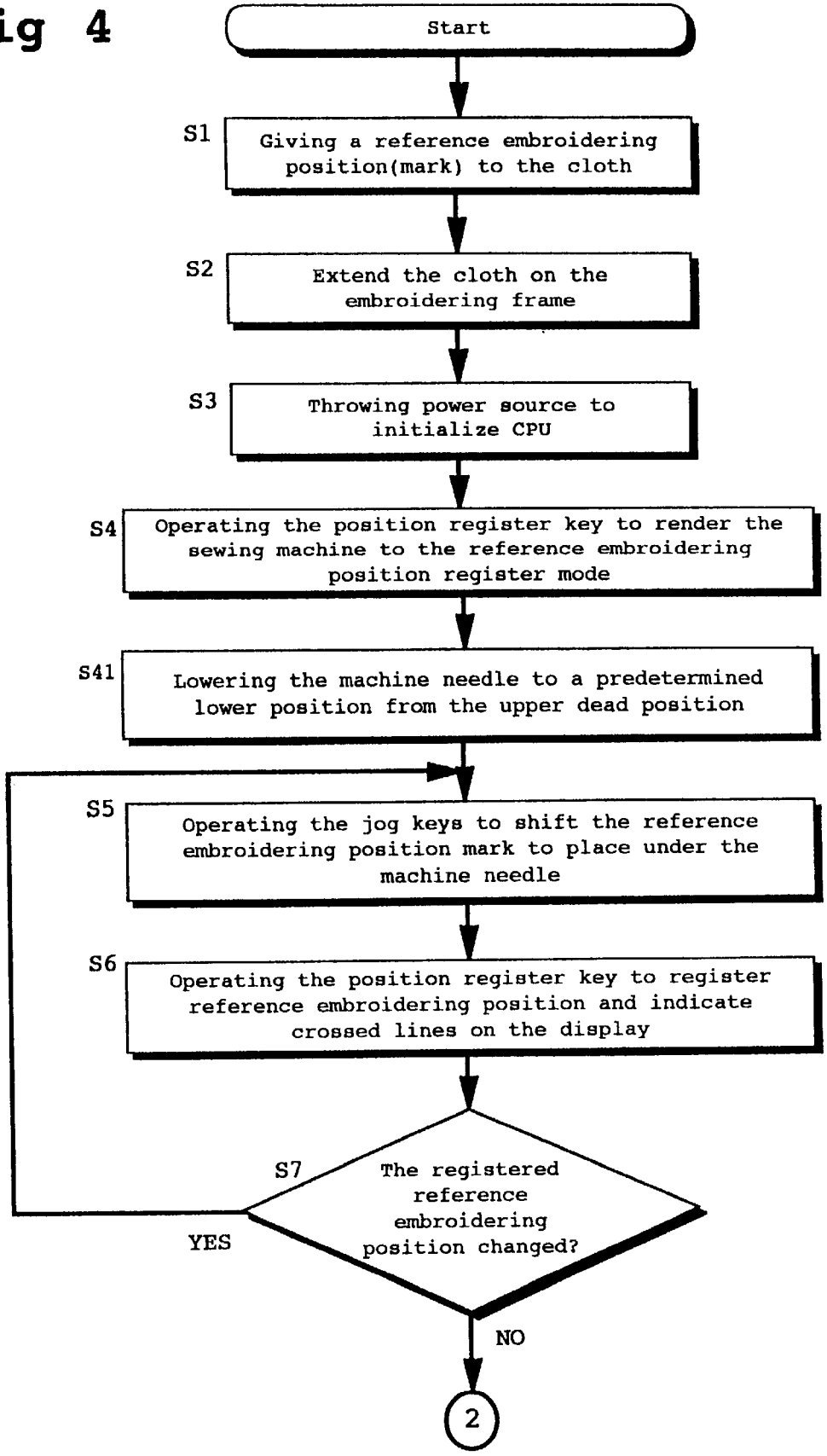
FIGS. 4 and 4(A) are a flow chart according to the device of the second embodiment of the invention.
Figure 4A:
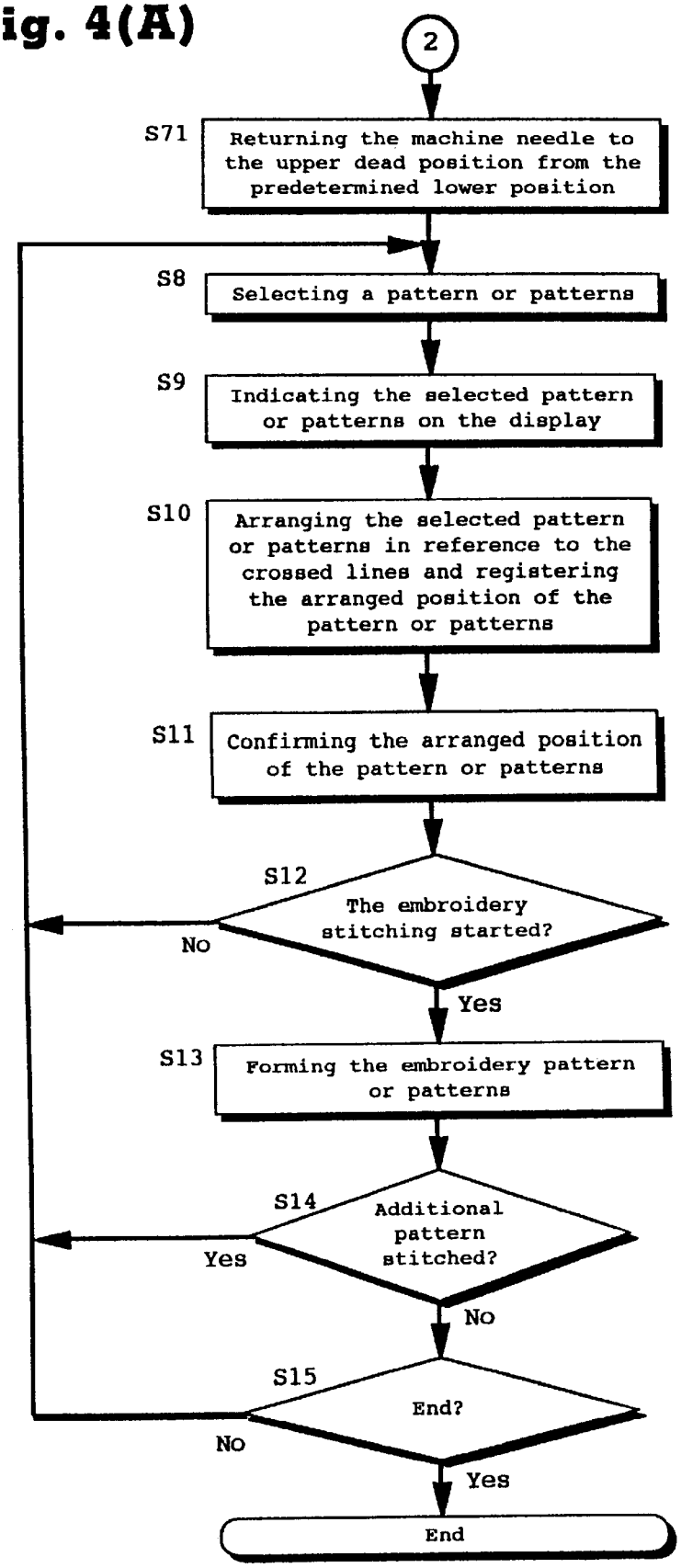

The function of the embodiment is shown by the flow chart as shown in FIG. 4 which is the same as the flow chart depicted in FIG. 2 except for being additionally provided with the step (S41) and a step (S71).

Figure 5:
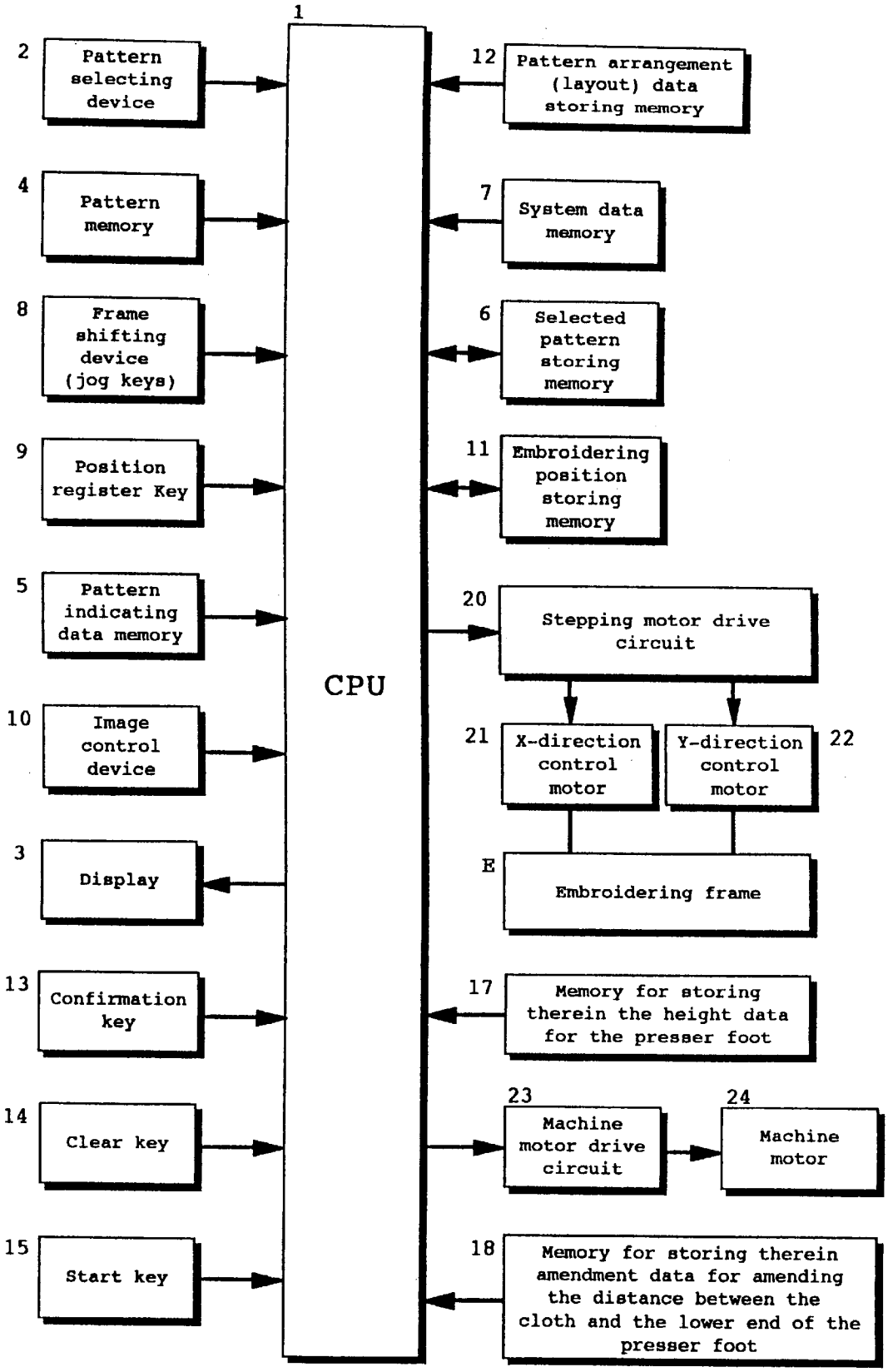
FIG. 5 is a block diagram showing a device of a third embodiment of the invention.
Figure 16C:
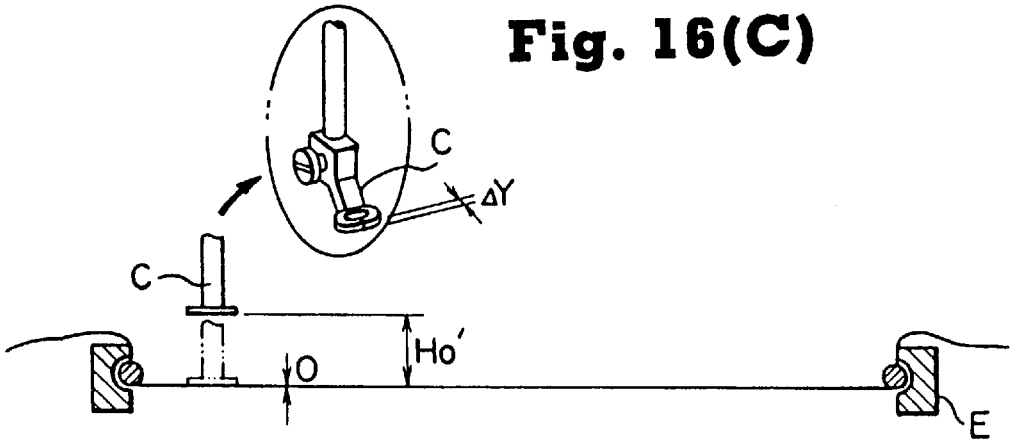
FIG. 16(C) shows the height of the presser foot C (Lower end) from the cloth is normally Ho' when the foot is brought up.

FIG. 5 shows a device according to a third embodiment of the invention. This embodiment is the same with the first embodiment except for being additionally provided with a presser foot height data memory 17 and an amendment data memory 18. As shown in FIG. 16(C), the height of the presser foot C (lower end) from the cloth is normally Ho' when the foot is brought up. The presser foot height data memory 17 stores therein the data for rendering the normal height Ho' of the presser foot C to the height where the lower end of the presser foot C is in contact with the cloth when the position registry key 9 is operated. This will enable the machine operator to more exactly place the reference embroidering position (q) under the presser foot C in alignment therewith. When the position register key 9 is operated again before the embroidering stitch is started, the presser foot C is returned to the normal height Ho'. The amendment data memory 18 stores therein the data for amending the position of the presser foot C with respect to the cloth approximately to the distance ΔY where the presser foot C is slightly spaced from the cloth.

Figure 6:
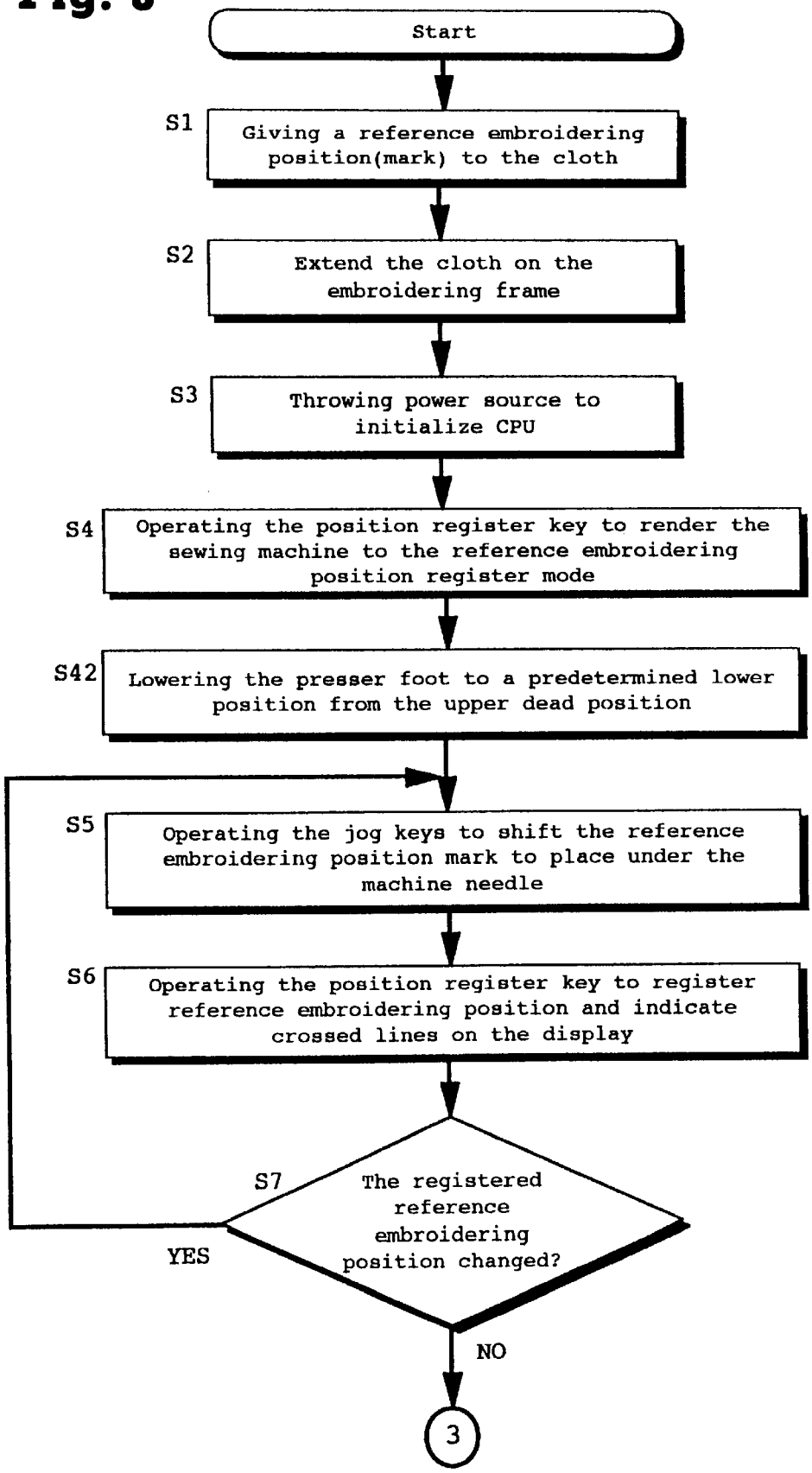
FIGS. 6 and 6(A) are a flow chart according to the device of the third embodiment of the invention.
Figure 6A:
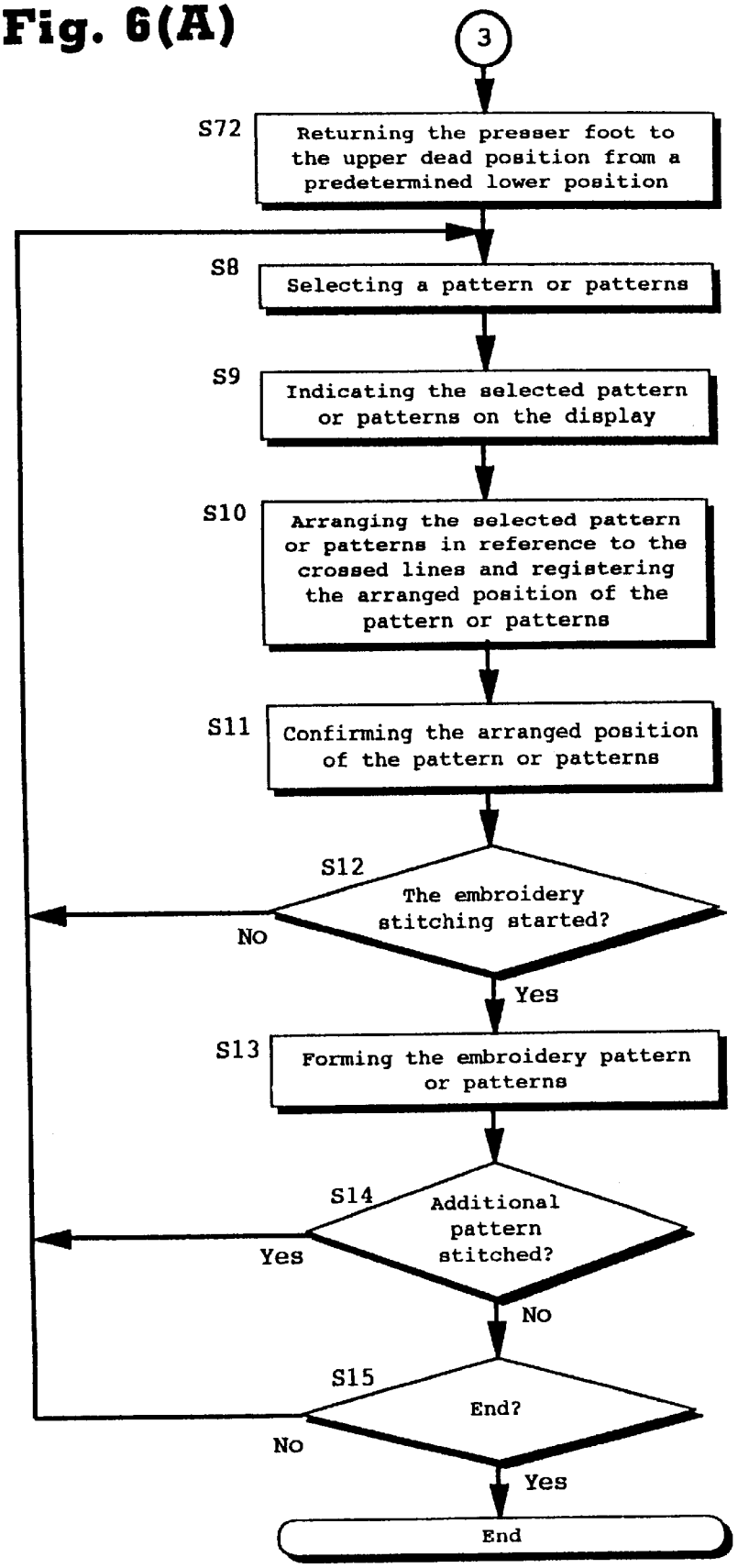
Figure 13A:
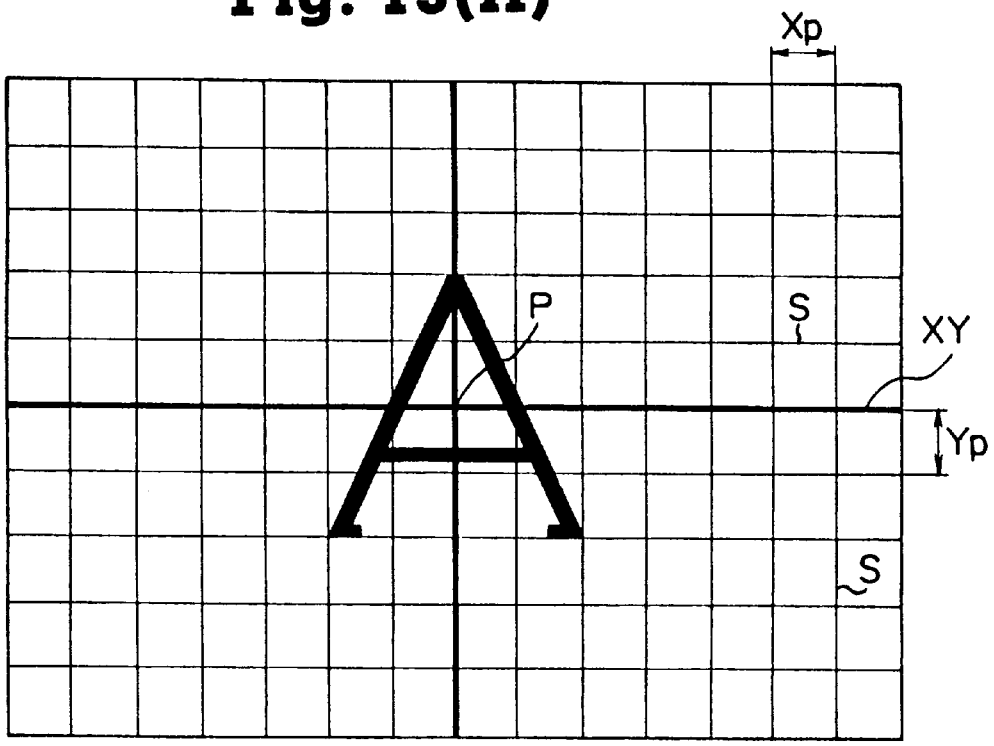
FIG. 13(A) is a plan elevational view of the display indicating thereon a plurality of auxiliary lines with a predetermined space provided therebetween in addition to the crossed lines XY and in connection with a pattern to be embroidered.
Figure 13B:
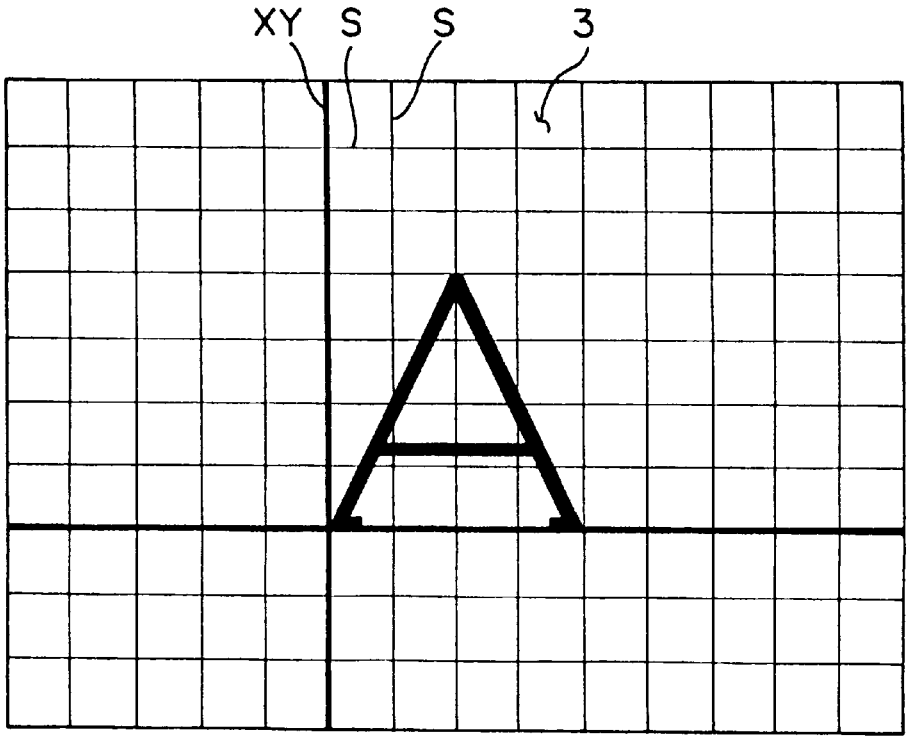
FIG. 13(B) is a plan elevational view of the display showing the crossed lines XY and the auxiliary lines shifted with respect to the pattern to decide the embroidering position of the pattern.

The function of the third embodiment is shown by the flow chart in FIG. 6. The flow chart is substantially the same as the one shown in FIG. 4 except for being provided with the step (S42). According to this embodiment, as mentioned above, the position registry key 9 is operated to read out the amendment data from the memory 18 to lower the presser foot C from the position Ho' to the position where the lower end of the presser foot C is in contact with the cloth. The position registry key 9 is operated again to return the presser foot C to the normal height Ho' (S72). FIG. 13(A) shows a device according to a fourth embodiment of the invention, wherein the display 3 indicates thereon auxiliary lines with a predetermined space Xp,Yp (for example, 1 mm) respectively provided therebetween together with the aforementioned crossed lines XY. This will enable the machine operator to make a fine adjustment when shifting the crossed lines XY with respect to the pattern as shown in FIG. 13(B).

Figure 14:
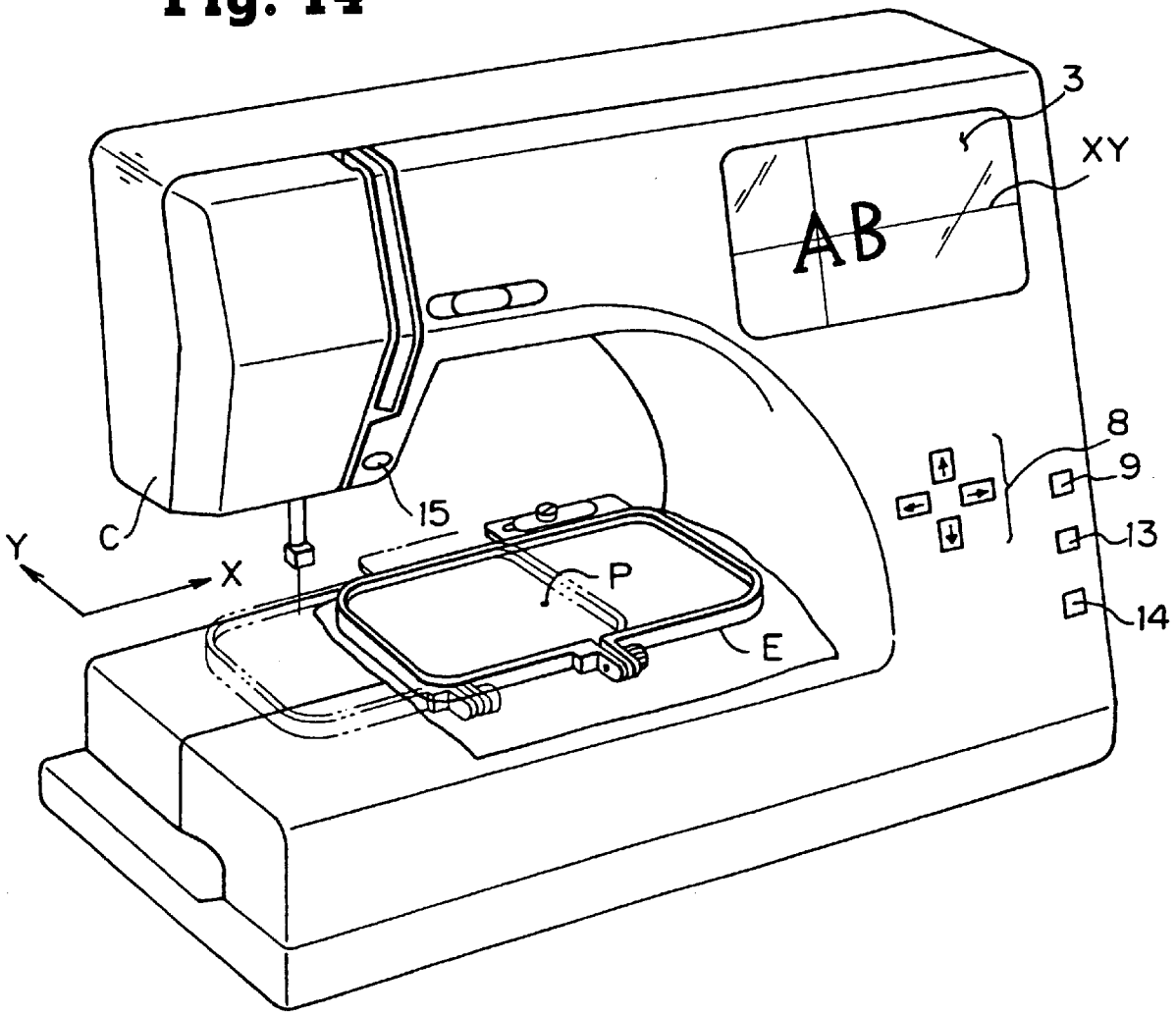
FIG. 14 is a perspective view of an embroidering sewing machine showing an example for indicating a plurality of selected patterns on the display.
Figure 15A:
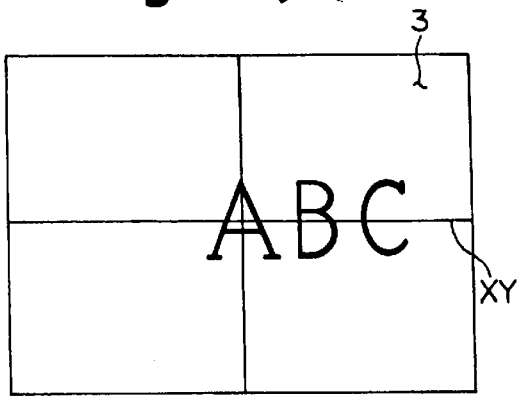
FIGS. 15(A)~(D) are plan elevational views of the display showing a plurality of selected patterns indicated in sequence in connection with the crossed lines XY while the patterns are selected.
Figure 15B:
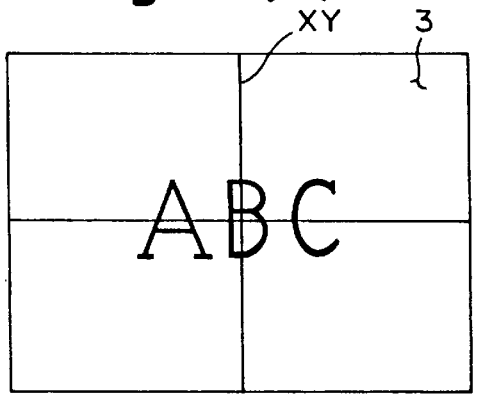
Figure 15C:
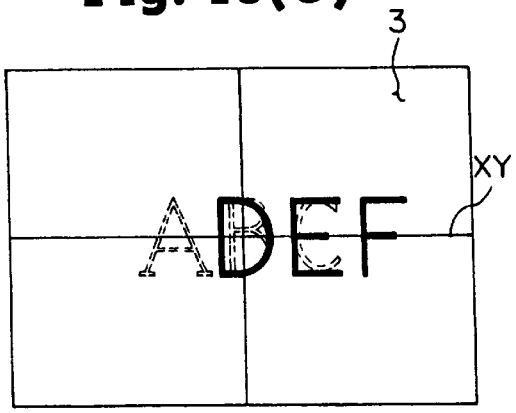
Figure 15D:
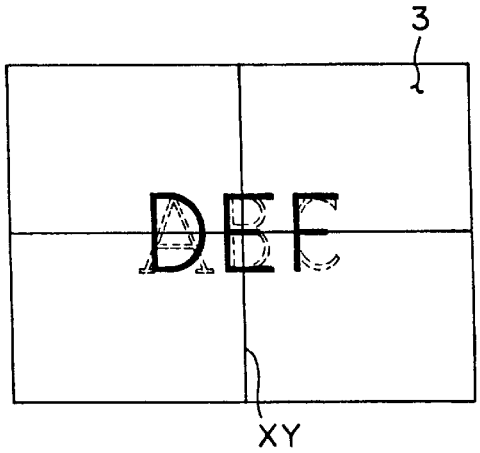
Figure 15E:
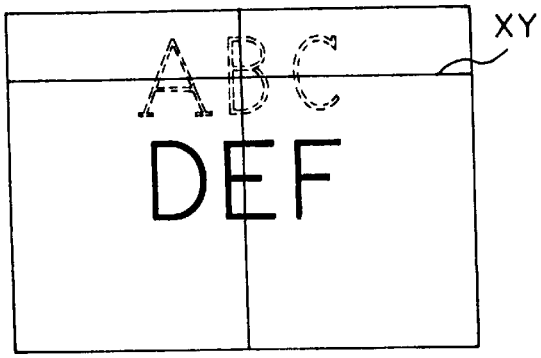
FIG. 15(E) is a plan elevational view of the display showing the plurality of patterns optionally arranged by optionally shifting the crossed lines XY.

FIGS. 14 and 15 show a device according to a fifth embodiment of the invention, wherein a plurality of patterns may be selected to be embroidered and indicated on the display 3. For example, when the patterns A, B and C are selected in this order, the first selected pattern A is indicated on the display 3 with the center thereof being located at the center of the crossed lines XY as shown in FIG. 15(A). This condition is confirmed by operation of the confirmation key 13. Then the center of the pattern group of A, B and C is shifted to the center of the crossed lines XY as shown in FIG. 15(B). Subsequently when the patterns D, E and F are selected in this order, the pattern D is indicated on the display 3 with the center thereof being located at the center of the crossed lines XY and the previously selected patterns A, B and C are indicated with broken lines or disappeared as shown in FIG. 15(C). This condition is confirmed by operation of the confirmation key 13. Then the center of the pattern group of D, E and F is shifted to the center of the crossed lines XY as shown in FIG. 15(D). The layout of such plurality of selected patterns may be optionally made by operation of the frame shifting device 8 which shift the crossed lines XY with respect to the patterns on the display 3 as shown in FIG. 15(E).

Figure 7:
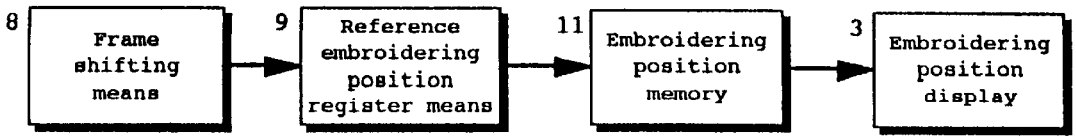
FIG. 7 is a block diagram showing a function of a method according to a first embodiment of the invention.

The method for setting the initial embroidering position is set forth below. According to the first embodiment of the invention, as shown in FIG. 7, the cloth to be embroidered is given the reference embroidering position (q) (one or two points, one point+one line , two lines and the like). Such marked cloth is extended on the embroidering frame E. The embroidering frame E is then attached to the X-Y drive mechanism of the sewing machine. The frame shifting device 8 is then operated to shift the embroidering frame E so that the reference embroidering position (q) of the cloth may be placed under the needle. The position register key 9 is then operated to store the so placed reference embroidering position (q) in the embroidering data memory 11 as the embroidering position data and simultaneously indicate on the display 3 the position (q) together with the crossed lines XY. Then the pattern selecting device 2 is selectively operated to select a desired pattern which is simultaneously indicated on the display 3. Then the frame shifting device 8 is operated to shift the embroidering frame E optionally with respect to the crossed lines XY thereby to optionally position the embroidering frame E.

Figure 8:
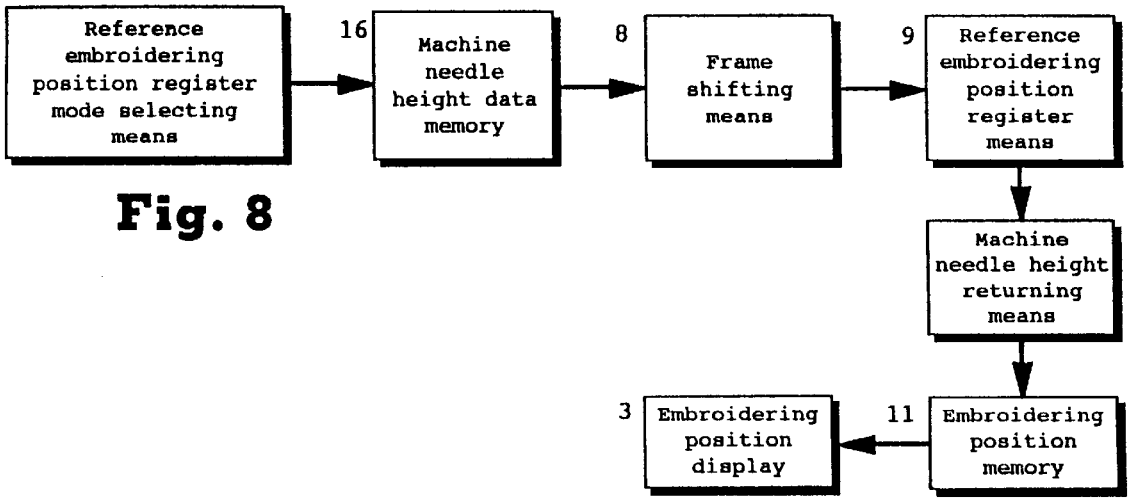
FIG. 8 is a block diagram showing a function of a method according to a second embodiment of the invention.

According to a method of the second embodiment of the invention, as shown in FIG. 8, the cloth so processed as mentioned above is extended on the embroidering frame E. The embroidering frame E is attached to the X-Y drive mechanism of the sewing machine. The position register key 9 is then operated to render the sewing machine to the position register mode wherein the machine needle is moved down from the upper position until it reaches the predetermined lower position spaced from the cloth. Subsequently the jog keys of the frame shifting device 8 are selectively operated to shift the embroidering frame E and locate the reference embroidering position (q) under the needle. The position register key 9 is operated again to store the position (q) in the embroidering position memory 11 as the embroidering position data and simultaneously indicate in the display 3 the position (q) together with the cross lines XY. The position register key 9 is operated again to return the needle to the normal upper position. The pattern selecting device 2 is then operated to select a desired pattern to be embroidered to be indicated on the display 3. The frame shifting device 8 is then operated to optionally shift the embroidering frame E thereby to optionally position the reference embroidering position mark with respect to the crossed lines XY.

Figure 9:
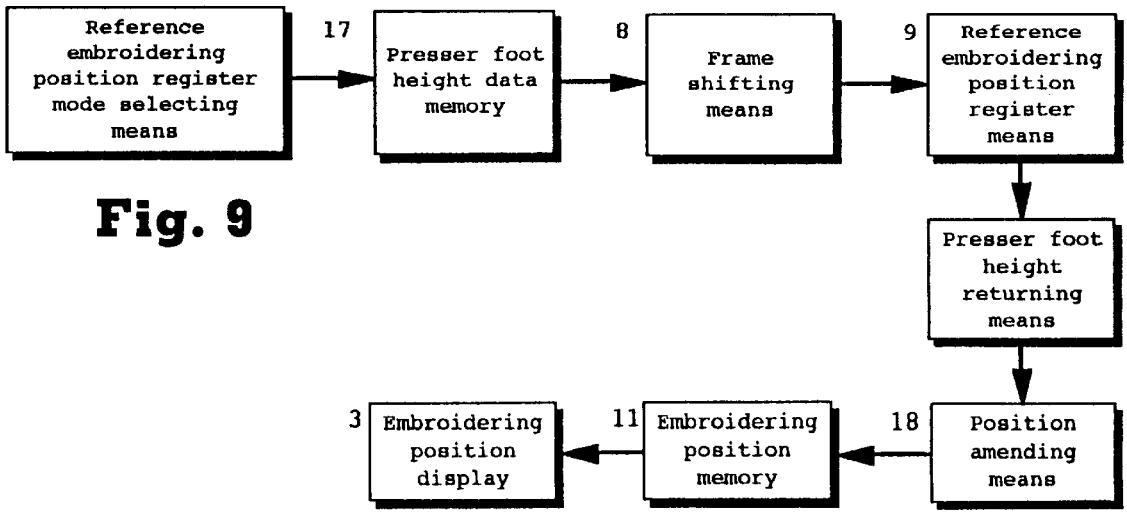
FIG. 9 is a block diagram showing a function of a method according to a third embodiment of the invention.

According to a method of a third embodiment of the invention, as shown in FIG. 9, the cloth so processed as mentioned in connection with the first and second embodiments is extended on the embroidering frame E. The embroidering frame E is attached to the X-Y drive mechanism of the sewing machine. The position register key 9 is then operated to render the sewing machine to the position register mode and to lower the presser foot C from the upper position to the lower position where the presser foot C is in contact with the cloth. The frame shifting device 8 is then operated to shift the embroidering frame E so that the reference embroidering position (q)of the cloth may be placed under the presser foot C. The position register key 9 is operated again to store the position (q) in the embroidering position memory 11 as the embroidering position data and indicate on the display 3 the position (q) together with the crossed lines XY. The position register key 9 is operated again to return the presser foot C to the upper position. The pattern selecting device 2 is then operated to select a desired pattern to be embroidered to be indicated on the display 3. The frame shifting device 8 is then operated to optionally shift the embroidering frame E with respect to the crossed lines XY thereby to optionally position the embroidering frame E.

It is understood that the preceding description is given merely by way of illustration and not in limitation of the invention and that various modifications may be made thereto without departing from the spirit of the invention as claimed.

What is claimed is:

1. An embroidering position setting device for an embroidering sewing machine having a pattern memory storing therein pattern data for a plurality of embroidery patterns which are selectively read out to operate a stitch forming device to form the stitches of a selected pattern or patterns on a cloth, the stitch forming device including a machine needle which is vertically reciprocated with respect to the cloth and an X-Y drive mechanism which is driven under control of the read out pattern data in synchronism with the reciprocation of the machine needle thereby to vary relative position between the machine needle and the cloth, said embroidering position setting device comprising:

an embroidering frame having a cloth extended thereon to be embroidered, said frame being adapted for connection to the X-Y drive mechanism;

a mark on the cloth at an optional position for representing a reference embroidering position;

means including a plurality of jog keys adapted for selectively operating the X-Y drive mechanism thereby shifting said embroidering frame so that said reference embroidering position on the cloth may be located at the position under the machine needle in vertical alignment therewith;

means including a position register key for storing the location of said reference embroidering position in an embroidering position memory as reference embroidering position data;

a display which is operative in response to said position register key to indicate thereon the location of said reference embroidering position;

means controlled by said position register key for causing said display to indicate crossed lines thereon; and means for selecting at least one of the embroidery patterns from the pattern memory, the selected embroidery pattern being stored in a selected pattern storing memory and being simultaneously indicated on said display with a center thereof being located at a center of said crossed lines.

2. An embroidering position setting device for an embroidering sewing machine having a pattern memory storing therein pattern data for a plurality of embroidery patterns which are selectively read out to operate a stitch forming device to form the stitches of a selected pattern or patterns on a cloth, the stitch forming device including a machine needle which is vertically reciprocated between an upper dead position above the cloth and a lowest position below the cloth and an X-Y drive mechanism which is driven under control of the read out pattern data thereby to vary relative position between the machine needle and the cloth, said embroidering position setting device comprising:

an embroidering frame having a cloth extended thereon to be embroidered, said frame being adapted for connection to the X-Y drive mechanism;

a mark on the cloth at an optional position for representing a reference embroidering position;

means including a position register key adapted for switching the sewing machine to a position register mode and simultaneously lower the machine needle to a predetermined lower position close to the cloth;

means including a plurality of jog keys adapted for selectively operating the X-Y drive mechanism thereby shifting said embroidering frame so that said reference embroidering position on the cloth may be located at the position under the machine needle in vertical alignment therewith, said position register key being operated to store the location of said reference embroidering position in an embroidering position memory as reference embroidering position data;

a display which is operative in response to said position register key to indicate thereon the location of said reference embroidering position, said position register key being operated to return the machine needle from the lower position to the upper dead position thereof after the location of said reference embroidering position has been stored in the embroidering position memory and indicated on said display;

means controlled by said position register key for indicating crossed lines on said display; and means for selecting at least one of the embroidery patterns, the selected pattern being indicated on said display with a center thereof being located at a center of said crossed lines.

3. An embroidering position setting device for an embroidering sewing machine having a pattern memory storing therein pattern data for a plurality of embroidery patterns which are selectively read out to operate a stitch forming device to form the stitches of a selected pattern or patterns on a cloth, the stitch forming device including a machine needle which is vertically reciprocated between an upper dead position above the cloth and lowest position below the cloth, a presser foot which is vertically reciprocated in synchronism with the machine needle between an upper dead position above the cloth and a lowest position where the presser foot presses the cloth when the machine needle penetrates the cloth and an X-Y drive mechanism which is driven under control of the read out pattern data thereby to vary relative position between the machine needle and the cloth, said embroidering position setting device comprising:

an embroidering frame having a cloth extended thereon to be embroidered, said frame being adapted for connection to the X-Y drive mechanism;

a mark on the cloth at an optional position for representing a reference embroidering position;

means including a position register key adapted for switching the sewing machine to a position register mode and simultaneously lowering the presser foot from the upper dead position to a predetermined lower position where the presser foot is in contact with the cloth;

means including a plurality of jog keys adapted for selectively operating the X-Y drive mechanism thereby shifting said embroidering frame so that said reference embroidering position on the cloth may be located at the position under the presser foot in vertical alignment therewith, said position register key being operated to store the location of said reference embroidering position in a embroidering position memory as reference embroidering position data;

a display which is operative in response to said position register key to indicate thereon the location of said reference embroidering position, said position register key being operated to return the presser foot to the upper dead position from the lower position after the location of said reference embroidering position has been stored in said embroidering position memory and indicated on said display;

means controlled by said position register key for indicating crossed lines on said display; and means for selecting at least one of the embroidery patterns, the selected pattern being indicated on said display with a center thereof being located at a center of said crossed lines.

4. The embroidering position setting device as defined in claim 1, wherein said means for causing said display to indicate crossed lines is controlled by said position register key to indicate on said display a plurality of auxiliary lines in addition to said crossed lines, said auxiliary lines having a predetermined space provided therebetween.

5. A method of operation of an embroidery position setting device for an embroidering sewing machine, the embroidery sewing machine having a pattern memory storing therein pattern data for a plurality of embroidery patterns which are selectively read out to operate a stitch forming device to form the stitches of a selected pattern or patterns on a cloth, the stitch forming device including a machine needle which is vertically reciprocated between an upper dead position above the cloth and a lowest position below the cloth and an X-Y drive mechanism which is driven under control of the read out pattern data thereby to vary relative position between the machine needle and the cloth, said method of operation of an embroidering position setting device comprising the steps of:

marking the cloth at an optional position for representing a reference embroidering position;

extending the cloth on an embroidering frame;

connecting said embroidering frame to the X-Y drive mechanism;

shifting said frame using the X-Y drive mechanism so that said reference embroidering position is located at the position under the machine needle in vertical alignment therewith;

storing the location of said reference embroidering position in an embroidering position memory as reference embroidering position data and simultaneously indicating the location of said reference embroidering position on a display;

indicating crossed lines on said display;

selecting at least one of the embroidery patterns; and indicating the selected pattern on said display with a center thereof being located at a center of said crossed lines.

6. The method of operation of an embroidery position setting device according to claim 5 further comprising the steps of:

after said step of connecting said embroidering frame to the X-Y drive mechanism, then lowering the machine needle from the upper dead position to a predetermined lower position close to the cloth; and after said step of storing the location of said reference embroidering position in an embroidering position memory then returning the machine needle to the upper dead position from the lower position.

7. A method of operation of an embroidery position setting device for an embroidering sewing machine, the embroidery sewing machine having a pattern memory storing therein pattern data for a plurality of embroidery patterns which are selectively read out to operate a stitch forming device to form the stitches of a selected pattern or patterns on a cloth, the stitch forming device including a machine needle which is vertically reciprocated between an upper dead position above the cloth and a lowest position below the cloth, a pressure foot which is vertically reciprocated in synchronism with the machine needle between an upper dead position thereof and a lowest position where the presser foot presses the cloth when the machine needle penetrates the cloth and an X-Y drive mechanism which is driven under control of the read out pattern data thereby to vary relative position between the machine needle and the cloth, said method of operation of embroidering position setting device comprising the steps of:

marking the cloth at an optional position for representing a reference embroidering position;

extending the cloth on an embroidering frame;

connecting said embroidering frame to the X-Y drive mechanism;

lowering the presser foot from the upper dead position thereof to a lower position where the presser foot is in contact with the cloth;

shifting said frame using the X-Y drive mechanism so that said reference embroidering position is located at the position under the presser foot in vertical alignment therewith;

storing the location of said reference embroidering position in an embroidering position memory as reference embroidering position data and simultaneously indicating the location of said reference embroidering position on a display; and returning the presser foot to the upper dead position from the lower position;

indicating crossed lines on said display;

selecting at least one of the embroidering patterns; and indicating the selected pattern on said display with a center thereof being located at a center of said crossed lines.

8. A combination of an embroidering position setting device and an embroidering sewing machine wherein:

said embroidering sewing machine comprises:

a pattern memory storing therein pattern data for a plurality of embroidery patterns which are selectively read out to operate a stitch forming device to form the stitches of a selected pattern or patterns on a cloth, said stitch forming device including a machine needle which is vertically reciprocated with respect to the cloth and an X-Y drive mechanism which is driven under control of said read out pattern data in synchronism with the reciprocation of said machine needle thereby to vary relative position between said machine needle and the cloth; and said embroidering position setting device comprises:

an embroidering frame having a cloth extended thereon to be embroidered, said frame being connected to said X-Y drive mechanism, a mark on the cloth at an optional position for representing a reference embroidering position, means including a plurality of jog keys for selectively operating said X-Y drive mechanism thereby shifting said embroidering frame so that said reference embroidering position on the cloth may be located at the position under said machine needle in vertical alignment therewith, means including a position register key for storing the location of said reference embroidering position in an embroidering position memory as reference embroidering position data, a display which is operative in response to said position register key to indicate thereon the location of said reference embroidering position, means controlled by said position register key for causing said display to indicate crossed lines thereon, and means for selecting at least one of the embroidery patterns from said pattern memory, the selected embroidery pattern being stored in a selected pattern storing memory and being simultaneously indicated on said display with a center thereof being located at a center of said crossed lines.

9. The embroidering position setting device as defined in claim 8, wherein said means for causing said display to indicate crossed lines is controlled by said position register key to indicate on said display a plurality of auxiliary lines in addition to said crossed lines, said auxiliary lines having a predetermined space provided therebetween.

10. A combination of an embroidering position setting device and an embroidering sewing machine wherein:

said embroidering sewing machine comprises:

a pattern memory storing therein pattern data for a plurality of embroidery patterns which are selectively read out to operate a stitch forming device to form the stitches of a selected pattern or patterns on a cloth, said stitch forming device including a machine needle which is vertically reciprocated between an upper dead position above the cloth and a lowest position below the cloth and an X-Y drive mechanism which is driven under control of the read out pattern data thereby to vary relative position between said machine needle and the cloth; and said embroidering position setting device comprising:

an embroidering frame having a cloth extended thereon to be embroidered, said frame being connected to said X-Y drive mechanism, a mark on the cloth at an optional position for representing a reference embroidering position, means including a position register key for switching said sewing machine to a position register mode and simultaneously lower said machine needle to a predetermined lower position close to the cloth, means including a plurality of jog keys adapted for selectively operating said X-Y drive mechanism thereby shifting said embroidering frame so that said reference embroidering position on the cloth may be located at the position under said machine needle in vertical alignment therewith, said position register key being operated to store the location of said reference embroidering position in an embroidering position memory as reference embroidering position data, a display which is operative in response to said position register key to indicate thereon the location of said reference embroidering position, said position register key being operated to return said machine needle from the lower position to the upper dead position thereof after the location of said reference embroidering position has been stored in said embroidering position memory and indicated on said display, means controlled by said position register key for indicating crossed lines on said display, and means for selecting at least one of the embroidery patterns, the selected pattern being indicated on said display with a center thereof being located at a center of said crossed lines.

11. The embroidering position setting device as defined in claim 10, wherein said means for indicating crossed lines on said display is controlled by said position register key to indicate on said display a plurality of auxiliary lines in addition to said crossed lines, said auxiliary lines having a predetermined space provided therebetween.

12. A combination of an embroidering position setting device and an embroidering sewing machine wherein:

said embroidering sewing machine comprising:

a pattern memory storing therein pattern data for a plurality of embroidery patterns which are selectively read out to operate a stitch forming device to form the stitches of a selected pattern or patterns on a cloth, the stitch forming device including a machine needle which is vertically reciprocated between an upper dead position above the cloth and a lowest position below the cloth, a presser foot which is vertically reciprocated in synchronism with the machine needle between an upper dead position above the cloth and a lowest position where the presser foot presses the cloth when the machine needle penetrates the cloth and an X-Y drive mechanism which is driven under control of the read out pattern data thereby to vary relative position between the machine needle and the cloth; and said embroidering position setting device comprising:

an embroidering frame having a cloth extended thereon to be embroidered, said frame being adapted for connection to the X-Y drive mechanism, a mark on the cloth at an optional position for representing a reference embroidering position, means including a position register key for switching the sewing machine to a position register mode and simultaneously lowering the presser foot from the upper dead position to a predetermined lower position where the presser foot is in contact with the cloth, means including a plurality of jog keys for selectively operating the X-Y drive mechanism thereby shifting said embroidering frame so that said reference embroidering position on the cloth may be located at the position under the presser foot in vertical alignment therewith, said position register key being operated to store the location of said reference embroidering position in an embroidering position memory as reference embroidering position data, a display which is operative in response to said position register key to indicate thereon the location of said reference embroidering position, said position register key being operated to return the presser foot to the upper dead position from the lower position after the location of said reference embroidering position has been stored in said embroidering position memory and indicated on said display, means controlled by said position register key for indicating crossed lines on said display, and means for selecting at least one of the embroidery patterns, the selected pattern being indicated on said display with a center thereof being located at a center of said crossed lines.

13. The embroidering position setting device as defined in claim 12, wherein said means for indicating crossed lines on said display is controlled by said position register key to indicate on said display a plurality of auxiliary lines in addition to said crossed lines, said auxiliary lines having a predetermined space provided therebetween.

14. An embroidering position setting device for an embroidering sewing machine having a pattern memory storing therein pattern data for a plurality of embroidery patterns which are selectively read out to operate a stitch forming device to form the stitches of a selected pattern or patterns on a cloth, the stitch forming device including a machine needle which is vertically reciprocated with respect to the cloth and an X-Y drive mechanism which is driven under control of the read out pattern data in synchronism with the reciprocation of the machine needle thereby to vary relative position between the machine needle and the cloth, said embroidering position setting device comprising:

an embroidering frame having a cloth extended thereon to be embroidered, said frame being adapted for connection to the X-Y drive mechanism;

a mark on the cloth at an optional position for representing a reference embroidering position;

a plurality of jog keys adapted for connection to the X-Y drive mechanism, said plurality of jog keys controlling the X-Y drive mechanism thereby shifting said embroidering frame so that said reference embroidering position on the cloth may be located at the position under the machine needle in vertical alignment therewith;

a position register key operable to store the location of said reference embroidering position in an embroidering position memory as reference embroidering position data;

a display which is operative in response to said position register key to indicate thereon the location of said reference embroidering position;

said position register key being operable to cause said display to indicate crossed lines thereon; and a selection device being operable to select at least one of the embroidery patterns from the pattern memory, the selected embroidery pattern being stored in a selected pattern storing memory and being simultaneously indicated on said display with a center thereof being located at a center of said crossed lines.

15. The embroidering position setting device as defined in claim 14, wherein said position register key being operable to cause said display to indicate a plurality of auxiliary lines thereon in addition to said crossed lines, said auxiliary lines having a predetermined space provided therebetween.

16. An embroidering position setting device for embroidering sewing machine having a pattern memory storing therein pattern data for a plurality of embroidery patterns which are selectively read out to operate a stitch forming device to form the stitches of a selected pattern or patterns on a cloth, the stitch forming device including a machine needle which is vertically reciprocated between an upper dead position above the cloth and a lowest position below the cloth and an X-Y drive mechanism which is driven under control of the read out pattern data thereby to vary relative position between the machine needle and the cloth, said embroidering position setting device comprising:

an embroidering frame having a cloth extended thereon to be embroidered, said frame being adapted for connection to the X-Y drive mechanism;

a mark on the cloth at an optional position for representing a reference embroidering position;

a position register key operable to switch the sewing machine to a position register mode and simultaneously to lower the machine needle to a predetermined lower position close to the cloth;

a plurality of jog keys adapted for connection to the X-Y drive mechanism, said plurality of jog keys controlling the X-Y drive mechanism thereby shifting said embroidering frame so that said reference embroidering position on the cloth may be located at the position under the machine needle in vertical alignment therewith, said position register key being operable to store the location of said reference embroidering position in an embroidering position memory as reference embroidering position data;

a display which is operative in response to said position register key to indicate thereon the location of said reference embroidering position, said position register key being operated to return the machine needle from the lower position to the upper dead position thereof after the location of said reference embroidering position has been stored in the embroidering position memory and indicated on said display;

said position register key being operable to cause said display to indicate crossed lines thereon; and a selection device being operable to select at least one of the embroidery patterns, the selected pattern being indicated on said display with a center thereof being located at a center of said crossed lines.

17. The embroidering position setting device as defined in claim 16, wherein said position register key being operable to cause said display to indicate a plurality of auxiliary lines thereon in addition to said crossed lines, said auxiliary lines having a predetermined space provided therebetween.

18. An embroidering position setting device for an embroidering sewing machine having a pattern memory storing therein pattern data for a plurality of embroidery patterns which are selectively read out to operate a stitch forming device to form the stitches of a selected pattern or patterns on a cloth, the stitch forming device including a machine needle which is vertically reciprocated between an upper dead position above the cloth and lowest position below the cloth, a presser foot which is vertically reciprocated in synchronism with the machine needle between an upper dead position above the cloth and a lowest position where the presser foot presses the cloth when the machine needle penetrates the cloth and an X-Y drive mechanism which is driven under control of the read out pattern data thereby to vary relative position between the machine needle and the cloth, said embroidering position setting device comprising:

an embroidering frame having a cloth extended thereon to be embroidered, said frame being adapted for connection to the X-Y drive mechanism;

a mark on the cloth at an optional position for representing a reference embroidering position;

a position register key operable to switch the sewing machine to a position register mode and simultaneously to lower the presser foot from the upper dead position to a predetermined lower position where the presser foot is in contact with the cloth;

a plurality of jog keys adapted for connection to the X-Y drive mechanism, said plurality of jog keys controlling the X-Y drive mechanism thereby shifting said embroidering frame so that said reference embroidering position on the cloth may be located at the position under the presser foot in vertical alignment therewith, said position register key being operable to store the location of said reference embroidering position in an embroidering position memory as reference embroidering position data;

a display which is operative in response to said position register key to indicate thereon the location of said reference embroidering position, said position register key being operated to return the presser foot to the upper dead position from the lower position after the location of said reference embroidering position has been stored in said embroidering position memory and indicated on said display;

said position register key being operable to cause said display to indicate crossed lines thereon; and a selection device being operable to select at least one of the embroidery patterns, the selected pattern being indicated on said display with a center thereof being located at a center of said crossed lines.

19. The embroidering position setting device as defined in claim 18, wherein said position register key being operable to cause said display to indicate a plurality of auxiliary lines thereon in addition to said crossed lines, said auxiliary lines having a predetermined space provided therebetween.

* * * * *